United States Patent [19]

Kirk et al.

[11] Patent Number: 4,468,936

[45] Date of Patent: Sep. 4, 1984

[54] EARRING EARFITTING WITH PRIMARY AND SECONDARY LOCKING MEANS

[75] Inventors: Roy Kirk; Alan Herbert, both of Hastings, England

[73] Assignee: Andra Jewels Limited, Hastings, Great Britain

[21] Appl. No.: 534,744

[22] Filed: Sep. 22, 1983

[51] Int. Cl.[3] ..... A44C 7/00

[52] U.S. Cl. ..... 63/12; 24/97

[58] Field of Search ..... 63/12, 13; 24/41, 72.7, 24/609, 102 FC, 97

[56] References Cited

U.S. PATENT DOCUMENTS

| | | | |
|---|---|---|---|
| 60,997 | 1/1867 | Carlos . | |
| 139,991 | 6/1873 | Allen | 24/97 |
| 328,565 | 10/1885 | Bowerman | 24/97 |
| 432,218 | 7/1890 | Williams . | |
| 658,644 | 9/1900 | Hirschbach | 24/97 |
| 669,099 | 3/1901 | Potts | 24/97 UX |
| 866,187 | 9/1907 | Brydges . | |
| 1,147,673 | 7/1915 | Blackburn et al. | 24/97 |
| 1,889,339 | 11/1932 | Weiss . | |
| 2,544,893 | 3/1951 | Morehouse . | |

FOREIGN PATENT DOCUMENTS

| | | |
|---|---|---|
| 7773 | 6/1980 | European Pat. Off. . |
| 31030 | 10/1984 | Fed. Rep. of Germany . |
| 812947 | 5/1937 | France . |
| 175 | 3/1886 | Italy . |
| 238783 | 8/1925 | United Kingdom . |
| 304107 | 1/1929 | United Kingdom . |

*Primary Examiner*—F. Barry Shay

*Attorney, Agent, or Firm*—Barlow & Barlow Ltd.

[57] ABSTRACT

The invention provides an earfitting for an earring to be worn on pierced ears. An earring post which in use is positioned in the pierced hole in the ear lobe has a spearhead hingedly mounted on the end thereof. The earring post and spearhead can be temporarily locked in mutual alignment to enable the earfitting to be passed through the ear lobe, whereafter the spearhead can be turned with respect to the earring post to secure the earfitting in place behind the ear lobe.

2 Claims, 7 Drawing Figures

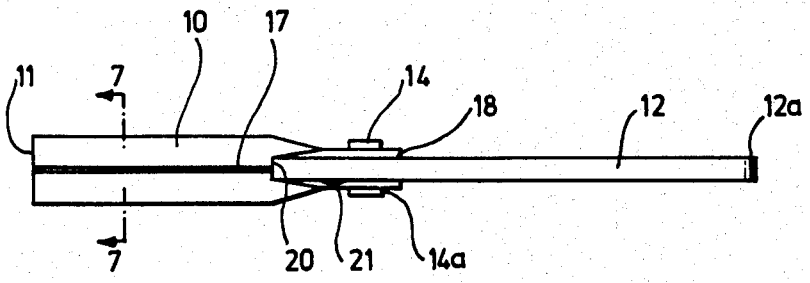
Fig.5.
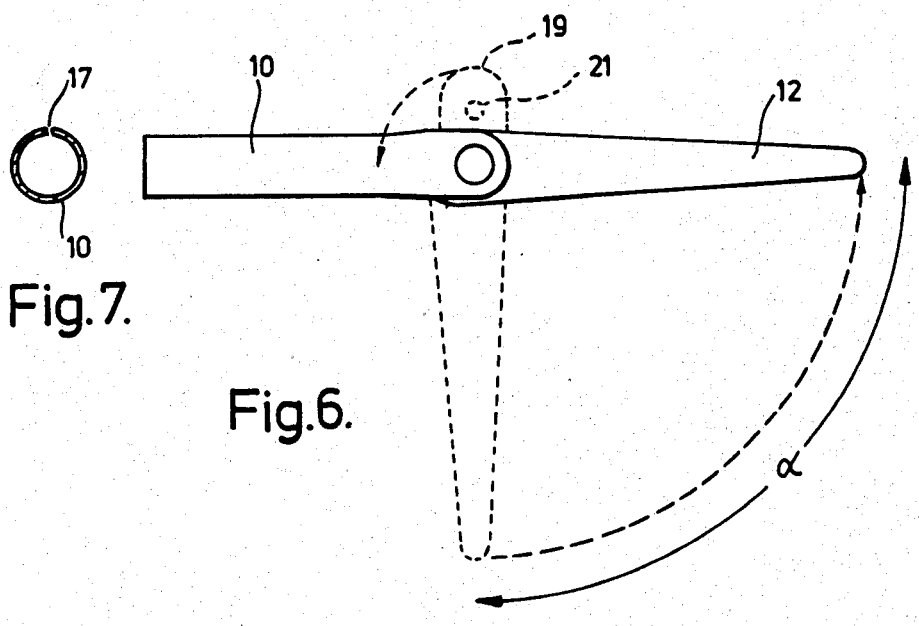
Fig.7.
Fig.6.

EARRING EARFITTING WITH PRIMARY AND SECONDARY LOCKING MEANS

This invention relates to improvements in earfittings for earrings to be worn on pierced ears.

A traditional type of earfitting used with earrings to be worn in pierced ears is known as a French fitting. This comprises a straight cylindrical bar (also referred to as an earring post) which passes through the pierced hole in the ear and is secured in place by a spring loaded scroll (also referred to as a bufferfly clip) behind the ear lobe. Alternatively, the bar may be threaded and secured in place by a corresondingly threaded wing nut behind the ear lobe. This fitting suffers from a number of disadvantages. It is difficult to secure the scroll or wing nut in place by sense of feel. The scrolls or wing nuts, being detachable and quite small, are easily lost. The wing nuts or scrolls, when made in precious metal, constitute a relatively high proportion of the total cost of the fitting. This not only affects the initial cost of the article, but must be considered when replacing lost scrolls or wing nuts.

British Patent Application GB No. 2074841 A discloses a threaded French fitting including a wing nut having a guide ring in register with the internally threaded portion. The provision of the guide ring facilitates assembly. However, in view of its significant weight and design, the wing nut still constitutes a high proportion of the total cost.

Another type of earfitting is the so-called safety wire. This comprises a hook-shaped wire which is passed through the ear lobe. A retaining member attached to the body of the earring is then engaged with the free end of the hook wire. The retaining member may be hinged to the body of the earring. In comparison with the French fitting, the hook wire is relatively difficult to insert through the ear lobe. It may also be uncomfortable to wear, as the ear lobes of people vary considerably in shape and thickness.

An object of the invention is to provide an improved earfitting which does not suffer from the above disadvantages.

The invention provides an earfitting for an earring to be worn on pierced ears, comprising an earring post which in use is positioned in the pierced hole in the ear lobe, and a spearhead hingedly mounted on the end of the earring post to be positioned behind the ear lobe, such that the earring post and spearhead can be mutually aligned to enable the earfitting to be passed through the ear lobe, whereafter the spearhead can be turned with respect to the earring post to secure the earfitting in place, and including primary locking means for temporarily locking the earring post and the spearhead in mutual alignment, and secondary locking means for resisting alignment of the earring post and the spearhead.

Primary locking means are provided for temporarily locking the earring post and spearhead in mutual alignment. This makes it easier to pass the earfitting through the ear lobe. Once in position, the spearhead is unlocked and turned with respect to the earring post, so that the earfitting is secured in place in the ear. The temporary locking involves a snap fit mechanism, so that the user can sense by feel when the earring post and spearhead are aligned. This makes it easier to align the two members when in position in the ear and then withdraw the earfitting.

The secondary locking means resist the alignment of the earring post and spearhead. As described in more detail below, this helps to avoid accidental near-alignment of the components with risk of loss of the earring.

In comparison with the prior art, the present invention provides the following advantages. When the earring post and spearhead are aligned, they can be passed through the pierced ear lobe as easily as a conventional French fitting. Once in position, turning of the spearhead to secure the earfitting in place is a simple matter and does not involve the manipulation purely by feel of two separate components behind the ear lobe. The final angle adopted by the spearhead relative to the earring post is variable, thereby providing comfortable wearing properties for ear lobes of varying shape and thickness, and, provided the spearhead and earring post are not in the mutually aligned position, the earfitting is held securely in the ear. As the scroll or wing nut of the conventional French fitting is dispensed with, there is no risk of loss of such components, and the weight of the fitting is reduced. The latter factor results in considerable saving of cost when the fitting is made from precious metal, such as gold.

Reference is now made to the accompanying drawings, in which:

FIG. 5 is a top view and FIG. 6 a side view of the assembled components rivetted and formed with the earring post into its final cylindrical shape;

FIG. 7 is a sectional view taken on lines 7—7 of FIG. 5.

Figure 1:
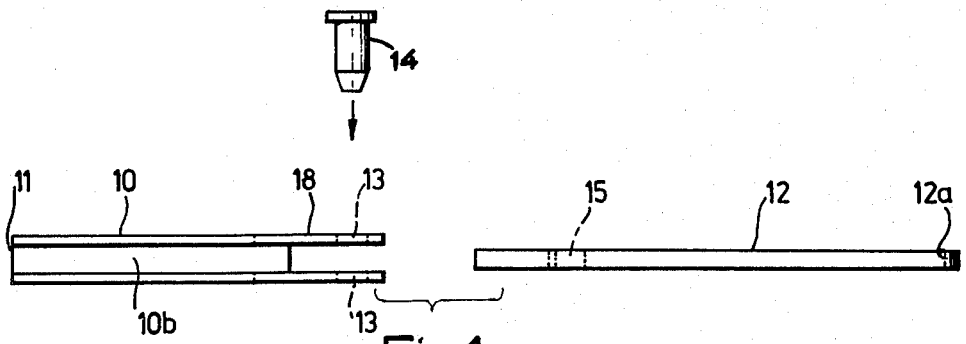
FIGS. 1 and 2 are respectively top and side views of the separated components embodied in the invention.
Figure 2:
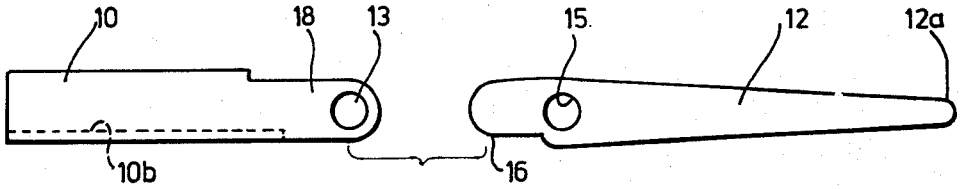

Referring first to FIGS. 1 and 2, one end 11 of the earring post 10 is attached to the decorative part of the earring (not shown), and one end 12*a* of the flat, sheet-metal spearhead 12 is tapered for insertion through the ear lobe. The earring post 10 is a U-shaped (in transverse section) sheet-metal channel member. The bottom 10*b* of the channel terminates shortly before the end adjacent the spearhead, and two holes 13 are provided in the sides 18 of the channel in this region to accommodate a rivet 14 which passes through a hole 15 in register on the spearhead. When the components have been assembled (FIGS. 3 and 4) before forming the channel section, the spearhead can freely rotate. In the aligned position, a portion 16 of the spearhead opposite the end 12*a* abuts against the lower internal surface of the channel. This prevents the spearhead from being rotated counterclockwise beyond an aligned position.

Figure 3:
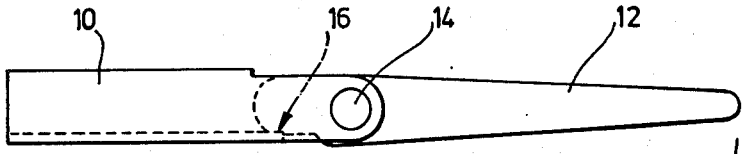
FIGS. 3 and 4 are respectively side and top views of the assembled components corresponding to FIGS. 1 and 2, constituting an intermediate stage in manufacture.
Figure 4:
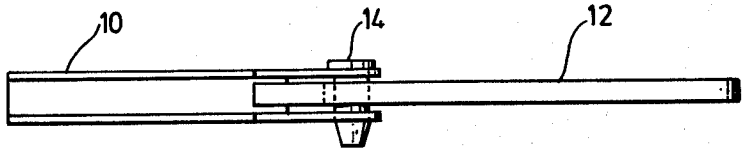

FIGS. 5 and 6 are respectively a top view and a side view of the earfitting with the earring post in its final cylindrical form, produced from the intermediate stage of manufacture shown in FIGS. 3 and 4.

This fitting is assembled as follows. The earring post is manufactured initially as a channel section, i.e. the member 10 of FIGS. 1 to 4. The spearhead is then engaged in a position at right angles to the earring post (i.e. as shown by the broken lines in FIG. 6). The holes in the spearhead and in the sides of the channel or wings 18 are aligned, the rivet 14 is inserted, and it is spun to make a head 14*a* on its end, thereby sealing it in position. The channel section of the earring post is then folded into a tubular hollow cylindrical section, leaving a narrow longitudinal gap or seam 17 and simultaneously pressing the wings 18 closer together so that the gap therebetween is just enough to accommodate the thickness of the spearhead 12. The seam is also shown in the partial transverse sectional view of the earring post in FIG. 7. The spearhead is then straightened into the aligned position for the first time. In this process, the end edge 19 of the spearhead is forced across an edge 20 of the earring post in the region of the end of the seam 17. In this first straightening the mechanism is stiff. The spearhead and earring post are made of relatively hard but still somewhat resilient material, such as a spring hard gold alloy. The material is deformed slightly in the first straightening operation, but thereafter operates more easily in the manner of a snap fit mechanism, a "set" having been put on the edge 20 of the earring post in the region of the end of the seam. The wearer can therefore feel a "click" when the spearhead is raised to the aligned position and this greatly facilitates withdrawal. This comprises the primary locking means.

The secondary locking means, operating concurrently with the primary locking means, is manufactured by creating a convex surface 21 on at least one side of the spearhead adjacent to the end 19. The surface 21 is exaggerated in the drawings for clarity.

This convex surface, by leverage on the adjacent enclosing sides 18 of the earring post, causes temporary flexing of the seam 17 as the effective cross-section of the spearhead gradually increases.

This interaction thus uses the entire earring post tube section as a semi-circular spring and, owing to the greater surface areas involved, permits a wider variation of materials, of differing hardness, to be used.

The secondary locking means performs an important and additional function in that it restricts the 'floating' of the spearhead and ensures that at all times there is a protrusion of the end of the spearhead 19 forming with the earring post a partial 'T' shape and increasing the cross sectional area of that part of the fitting located behind the ear lobe. This prevents the fitting either accidentally falling out of or being pulled out of the ear.

In the absence of the secondary locking means, the spearhead will "float", i.e. rotate freely with the "angle of drop" $\alpha$ (see FIG. 6) varying from 90° to about 10°. Only when $\alpha$ is less than about 10° will the primary locking means (snap-fit mechanism) be effective to prevent floating. However, for any value of $\alpha$ less than about 45°, there is a substantial risk of the fitting slipping out of the ear lobe. This risk increases with decreasing values of $\alpha$. The secondary locking means described above avoids this risk by providing for gradual resistance to alignment when $\alpha$ is less than about 45°. It is desirable to retain free rotation for values of $\alpha$ between 45° and 90° so that the fitting can adopt a comfortable position for different sizes and shapes of ear lobes.

The mechanisms described lock the spearhead and earring post temporarily in the aligned position, and this locking can be manually overriden by the wearer once the earfitting has been inserted, thereby to facilitate withdrawal.

We claim:

1. An earfitting for an earring to be worn on pierced ears, comprising an earring post which in use is positioned in the pierced hole in the ear lobe, and a spearhead hingedly mounted on the end of the earring post to be positioned behind the ear lobe, such that the earring post and spearhead can be mutually aligned to enable the earfitting to be passed through the ear lobe, whereafter the spearhead can be turned with respect to the earring post to secure the earfitting in place, and including primary locking means for temporarily locking the earring post and the spearhead in mutual alignment, said primary locking means including cooperating edges respectively on the earring post and on the spearhead which are adapted to engage each other in a snap-fit mechanism when the earring post and spearhead are mutually aligned, and secondary locking means completely independent of said primary locking means for resisting alignment of the earring post and the spearhead.

2. An earfitting as claimed in claim 1, wherein the secondary locking means comprises a hollow cylindrical portion of the earring post with a longitudinal gap and of sufficiently resilient material to permit flexing with widening of the gap; two parallel surfaces of the earring post integral with the hollow cylindrical portion and enclosing therebetween a portion of the spearhead; and a convex region on said portion of the spearhead, such that, as the spearhead and earring post are gradually aligned, the convex region engages with one of the parallel surfaces to gradually increase the spacing therebetween, whereby the integral hollow cylindrical portion is increasingly flexed.

* * * * *